United States Patent [19]

Sands et al.

[11] Patent Number: 4,494,176

[45] Date of Patent: Jan. 15, 1985

[54] LAMPS HAVING MULTIPLE AND AIMED PARABOLIC SECTIONS FOR INCREASED USEFUL LIGHT OUTPUT

[75] Inventors: Robert W. Sands, Hudson; Joseph P. Marella, Chardon; Thomas F. Fink, Jr., Macedonia, all of Ohio

[73] Assignee: General Electric Company, Schenectady, N.Y.

[21] Appl. No.: 589,903

[22] Filed: Mar. 14, 1984

[51] Int. Cl.[3] ..... F21V 7/00

[52] U.S. Cl. ..... 362/297; 362/307; 362/308; 362/309; 362/310; 362/346; 362/347; 362/375; 362/350

[58] Field of Search ..... 362/297, 307, 308, 309, 362/310, 346, 347, 375, 350

[56] References Cited

U.S. PATENT DOCUMENTS

| | | | |
|---|---|---|---|
| Re. 30,832 | 12/1981 | La Giusa | 313/113 |
| 3,443,086 | 5/1969 | Rikis | 362/346 |
| 4,408,266 | 10/1983 | Sclippa | 362/297 |
| 4,420,800 | 12/1983 | Van Horn | 362/297 |
| 4,420,801 | 12/1983 | Reiling | 362/297 |
| 4,447,865 | 5/1984 | Van Horn | 362/297 |

*Primary Examiner*—Donald P. Walsh

*Attorney, Agent, or Firm*—John P. McMahon; Philip L. Schlamp; Fred Jacob

[57] ABSTRACT

A reflector lamp having multiple and aimed parabolic reflective sections so as to improve the desired beam pattern is disclosed. The reflector lamp may be of the parabolic aluminized reflector (PAR) or the reflector (R) type lamps having primary, multiple intermediate and rear sections of a parabolic contour which improves the internal light reflective and absorption characteristics of the reflector lamp. The overall effect is to improve the optical efficacy of the reflector lamp.

14 Claims, 5 Drawing Figures

LAMPS HAVING MULTIPLE AND AIMED PARABOLIC SECTIONS FOR INCREASED USEFUL LIGHT OUTPUT

BACKGROUND OF THE INVENTION

This invention is in the field of reflector lamps, such as those which include the commonly known Parabolic Aluminized Reflector (PAR) lamp and the Reflector (R) lamp both used for floodlighting and as spotlights. In such lamps, the light source is recessed in a concave reflector which reflects frontwardly in a desired beam pattern substantially more than half of the total light output of the light source of the lamps.

PAR reflector lamps are disclosed in U.S. Pat. No. Re. 30,832 of F. F. LaGiusa, Reissued Dec. 22, 1981; U.S. Pat. Nos. 4,420,801 of G. H. Reiling et al and 4,420,800 of D. D. Van Horn; U.S. application Ser. Nos. 377,754 of D. D. Van Horn et al, filed May 13, 1982; and 517,193 of A. Munoz et al filed July 26, 1983, all of which are assigned to the assignee of the present invention.

U.S. patent application Ser. No. 349,334, now U.S. Pat. No. 4,420,800 discloses a reflector lamp comprising a finite light source positioned substantially at the focal point of a concave reflector. The concave reflector of such a lamp can be comprised of a front reflective surface which has a parabolic shape, an intermediate reflective surface which is spheroid, and a rear reflective surface which has a parabolic shape, all of which surfaces reflect light from the light source in a frontward manner. The front, intermediate and rear sections have a confocal point. The prior art reflector lamp further comprises a light source positioned at the confocal point of the concave reflector. Such a reflector lamp still further preferably comprises a lens positioned over the front of the reflector.

The prior art type of reflector lamp directs the emitted light into a desired beam pattern which is transmitted out of the lamp through the lens. Of the total lumens of light rays developed by the light source of the prior art reflector lamp, an undesirable amount of light rays are absorbed or disadvantageously reflected by the reflective surfaces of the reflector in such a manner so as to end up outside of the desired or main beam pattern and therefore these rays are considered unusable. These unusable rays are mainly wasted (1) by being undesirably and internally absorbed by the reflector, and (2) by being directed to areas within the reflector which when reflected by the internal surfaces of the lamp result in light rays which fall outside of the desired beam pattern. It is desired that a reflector lamp be provided which reduces the undesirable amount of lumens internally absorbed by the reflector and undesirably reflected by the internal surfaces of the reflector so as to improve the amount of useful light emitted by the reflector lamp. The overall effect of such a reflector would increase the percentage of the source of lumens that end up in the useful beam pattern.

Accordingly, objects of the present invention are to provide a more efficient reflector lamp with enhanced optical efficacy having, (1) a reduced amount of internal absorption, and (2) internal reflective surfaces that more advantageously direct the light rays into the useful beam pattern of the reflector lamp.

These and other objects of the present invention will become more apparent upon consideration of the following description of the invention.

SUMMARY OF THE INVENTION

In accordance with the present invention a reflector lamp having multiple parabolic sections which improve the useful light output of the reflector lamp is provided. The reflector lamp comprises a concave reflector and a finite light source having its geometric center located approximately at the focal point of the concave reflector. The concave reflector comprises a parabolic reflective section and at least first and second additional parabolic sections. The first and the second additional parabolic sections are reflective and have a substantially common focal point confocal with the focal point of the concave reflector. The first and second parabolic additional sections are so aligned relative to the finite light source as to be effective to reflect light rays impinging on their surfaces thereof onto the primary parabolic reflective section and thereby directing the light rays in an improved columinated beam pattern. It is preferred that the reflector lamp have a lens located at the front entrance of the reflector.

A more complete understanding of the present invention is obtained by considering the following detailed description in conjunction with the accompanying drawing.

DESCRIPTION OF THE PREFERRED EMBODIMENTS

Figure 1:
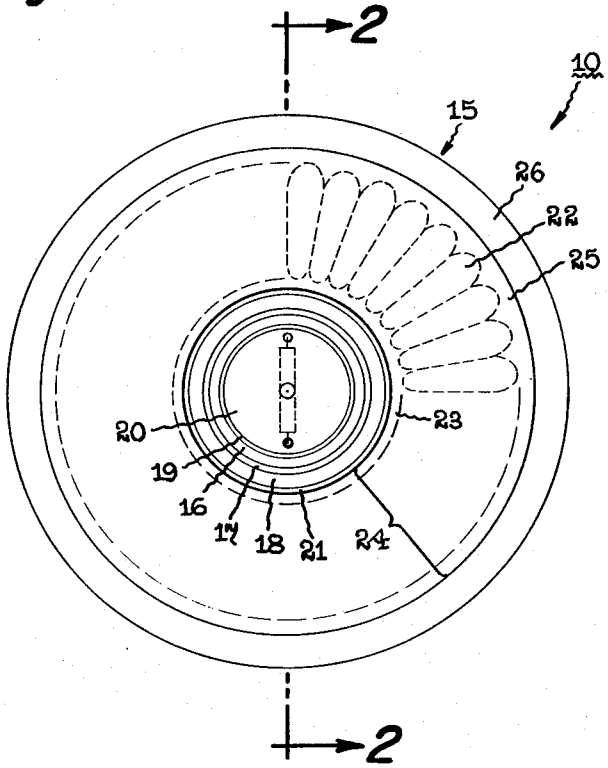
FIG. 1 is a front view of the reflector lamp in accordance with the preferred embodiment of the present invention.

FIG. 1 shows a front view of an improved reflector lamp 10 in accordance with one embodiment of the present invention. The lamp 10 comprises a light source 14 having a geometric center located approximately at the focal point 12 of the lamp 10. The lamp 10 further comprises a reflector assembly 15 having a rear section 20, a first intermediate section 16, a second intermediate section 18, transitional sections 17, 19 and 21, and a front section 24.

The light source 14 may be preferably axially aligned in a vertical manner parallel to the lamp axis, as indicated in FIG. 1 by a solid circle, or, it may be aligned in a horizontal manner perpendicular to the lamp axis as shown in phantom in FIG. 1. The horizontal aligned light source may be utilized for a lamp 10 to provide an asymmetrical beam pattern. For such a horizontally aligned light source, the reflector lamp 10 may further comprise longitudinally extending facets 22 (shown in phantom).

The facets 22 preferably occupy a major portion of the front reflector section 24 which is shown as having two unfaceted portions 23 and 25. The facets 22 are desired for certain applications to provide a certain degree of beam diffusion which, in turn, is desired with horizontal light sources so as to provide asymmetrical beam patterns in order to obtain beam patterns emitted by lamp 10 which are functionally smooth and of an esthetic quality. The facets 22 may be of the type described in the previously mentioned U.S. patent application Ser. No. 377,754 and to which reference may be made for further details of facets 22.

Figure 2:
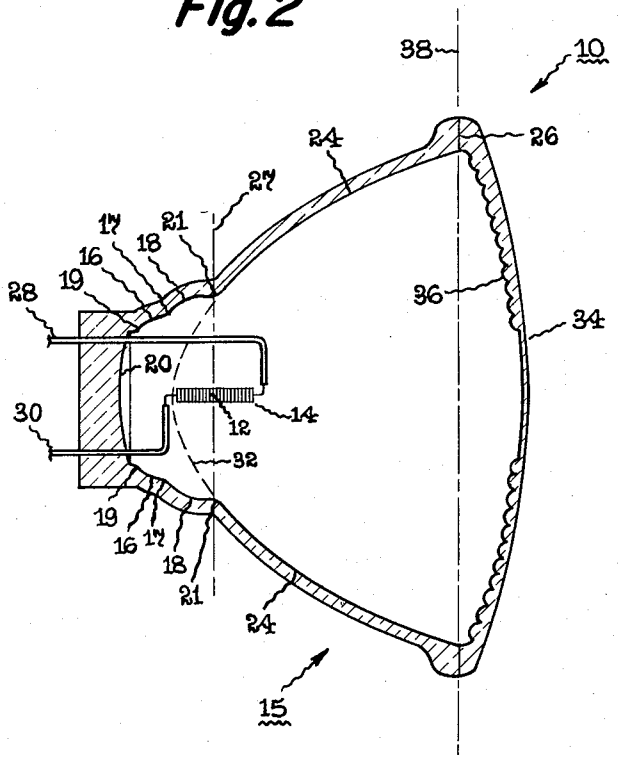
FIG. 2 is a cross sectional view taken along lines 2—2 of FIG. 1.

The reflector lamp 10 further preferably comprises a lens 34 mated to a reflector rim 26 at the front plane 38 shown in FIG. 2. The lens 34 is shown as preferably contoured and having a portion formed in a commonly known lenticular pattern 36. The primary function of lens 34 is to spread the reflected and directed light emitted by lamp 10 more effectively into a desired beam spread. The lens 34 is placed and sealed against the reflector rim 26 so as to protect and keep clean the internal reflecting surfaces of reflector 15 and also to seal the light source 14. The reflector 15 can be made of molded or blown glass and its inner surfaces can be coated with aluminum, silver, or any other reflective material to provide specular surfaces. Further, the reflector 15 and the lens 34 can also be of a plastic material having a coating to provide specular surfaces.

The section of the reflector assembly 15 of FIG. 1 taken perpendicular to the optical axis of lamp 10 is circular. The light source 14 of FIG. 1 is neither infinite nor infinitesimal in size so that the light source 14 is approximately centered at the focal point 12 of the reflector as generally either perpendicular or parallel to the lamp axis. Further details of the reflector assembly 15 are shown in FIG. 2 which is a longitudinal sectional view along lines 2—2 of FIG. 1.

The light source 14 of FIG. 2 can be a filament preferably made of tungsten and mounted on a pair of inner leads 28 and 30 of suitable material such as nickel. Alternative light sources can also be employed in place of the tungsten filament such as a halogen regenerative cycle lamp envelope or arc discharge lamp. These alternative light sources act as a finite light source. The finite light source 14 is located substantially in the plane 27 which passes through the focal point 12 commonly referred to as the latus rectum.

The reflector 15 has a concave shape and is further shaped so that (1) its front reflective section 24 has a substantially parabolic contour with respect to focal point 12 and having a lower parabolic portion shown in FIG. 2 in phantom by curve 32, (2) its first intermediate reflective section 18 has a substantially parabolic contour with respect to focal point 12, (3) its second intermediate reflective section 16 has a substantially parabolic contour with respect to focal point 12, and (4) its rear reflective section 20 has a substantially parabolic contour with respect to focal point 12.

The front reflective section 24 is joined to the first intermediate reflective section 18 by a transitional section 21 having a predetermined radius. The first intermediate reflective section 18 is joined to the second intermediate reflective section 16 by a transitional section 17 having a predetermined radius. The second intermediate reflective section 16 is joined to the rear reflective section 20 by a transitional section 19 having a predetermined radius. Transitional sections 21, 17, and 19 may each have a typical radius in the respective ranges of about 3 to about 4 mm, about 1 to about 2 mm, and about 1 to about 2 mm.

As discussed in the "Background" section above, it is desired that reflector lamps, such as reflector lamp 10 direct the light emitted by the light source 14 into a desired beam pattern. As further discussed, of the total lumens of the light rays created by the light source of prior art reflector lamps, an undesirable amount of light rays emitted by the light source are wasted mainly by (1) being absorbed by the internal surfaces of the reflector due to multiple internal reflections, and, (2) being directed to areas internal to the reflective surfaces which reflect such rays into an unusable or nondesired beam pattern.

In general, the reflector lamp 10 of the present invention is optically contoured so as to increase and direct the useful light into its main beam pattern. The present invention provides this increase mainly by the parabolic arrangement of the rear geometry of lamp 10. The rear geometry of lamp 10 comprises multiple parabolic sections 16, 18 and 20 which aim and columinate more of the light rays of the finite light source 14 from the front or the main parabolic section 24 more efficiently than prior art devices. This aiming and improved columination allows more of the lumens that are emitted by the finite light source 14 which otherwise would not initially strike the main parabolic section 24 to be directed so as to reflect off the main parabolic section primarily on their first reflection from the rear geometry of lamp. The present invention, in part, substantially reduces multiple internal reflections of the light rays which are typically experienced by prior devices and which cause the light rays to be undesirably absorbed or wasted by the internal surfaces of the prior lamps. These otherwise wasted light rays are directed by the present invention into the useful beam area.

The present invention optically adapts the individual characteristic of each of the rear geometry components 18, 16 and 20 so as to improve the overall optical efficacy of the lamp 10. The overall effect of the reflector lamp 10 is to distribute more advantageously the total candlepower distribution and zonal lumens emitted by the finite light source 14 into a directed and desired light beam output.

Figure 3:
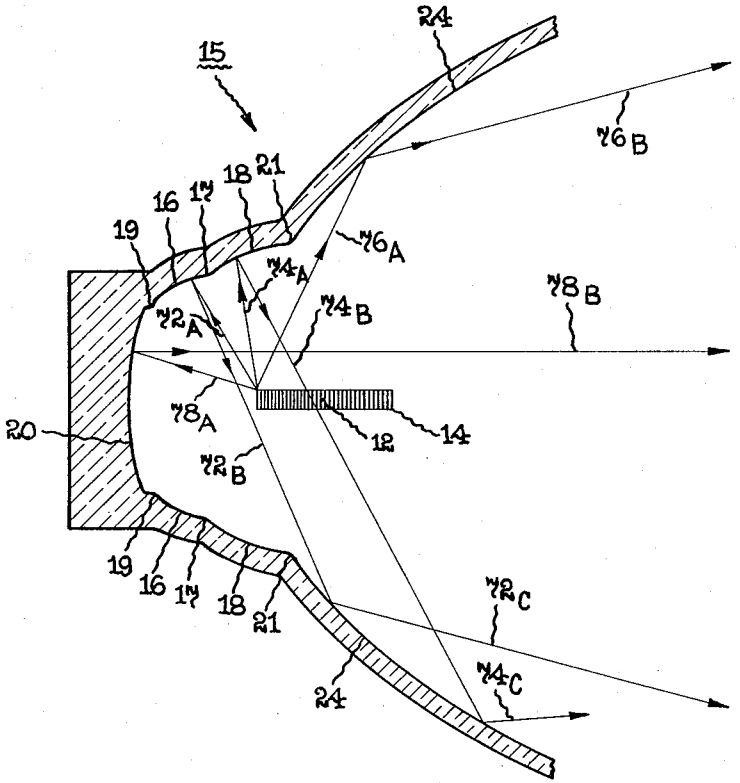
FIG. 3 is a partially segmented view illustrating improved light rays reflected internal of the lamp of FIG. 2.

The operation of the improved rear geometry of the present invention may be described with reference to FIG. 3. FIG. 3 mainly illustrates the improved light distribution of the rear geometry comprised of the parabolic section 18, 16 and 20. These parabolic sections 18, 16 and 20 have a focal point substantially as that of the lamp focal point 12.

FIG. 3 is a partially segmented view of the lamp 10 so as to illustrate the improved direction of the light rays emitted by the finite light source 14 into a desired beam pattern output. FIG. 3 illustrates the reduced multi-reflections of light rays that otherwise cause the unwanted absorption by the internal surfaces of the reflector creating wasted light. FIG. 3 further shows reflections of light rays $72_B$, $74_B$, $76_B$, and $78_B$ to illustrate one of the primary operations of the present invention.

Although only light rays $72_A \ldots 78_B$ are illustrated in FIG. 3 as representative of related light rays emitted from the end portion of the finite light source 14, it is to be understood that the practice of this invention also applies to light rays (not shown) emitted from all of the other portions of the finite light source 14.

Light ray $72_A$ when emitted from light source 14, strikes reflective surface 16 and is reflected as light rays $72_B$ onto the main parabolic section 24 and is then reflected as ray $72_C$ into the desired beam pattern. Light ray $74_A$ when emitted from light source 14, strikes the section 18 and is reflected as light ray $74_B$ onto section 24 and is then reflected as ray $74_C$ into the desired beam pattern. The light ray $76_A$ emitted by the light source 14 strikes the primary surface 24 and is reflected as light ray $76_B$ into the desired beam pattern. Similarly, light ray $78_A$ emitted by the light source 14 strikes the rear surface 20 and is reflected as light ray $78_B$ into the desired beam pattern. It should be noted that the paths of light rays $72_A$ . . . $78_B$ experience a maximum of two reflections by the internal surfaces of the reflector 15 in being directed into the desired beam pattern. This is a substantial reduction with respect to prior devices wherein light rays, similar to light rays $72_A$ and $74_A$, emitted from a light source may experience three, four, five, six and even seven internal reflections before being directed into the desired beam pattern. Further, it is possible that the prior light rays emitted from a light source may even be absorbed by being constantly reflected by the internal surfaces of the reflector and by not finding their ways into the desired beam pattern.

The rear geometry parabolic surfaces 16, 18 and 20, are aimed in a more columinated manner so as to reduce internal reflections of the light rays and improve the efficiency of the beam pattern by the lamp 10. More specifically, parabolic surfaces 16 and 18 are primarily aimed to have their reflected rays fall on the primary surface 24 to increase the light in the useful beam of the lamp 10.

It will now be appreciated that the parabolic reflective surfaces 16, 18 and 20, are adapted to direct otherwise wasted light into the desired beam pattern.

The practice of the present invention in accordance with the foregoing description of the reflector lamp 10 provides an efficacy improvement of 20% over standard parabolic reflector lamps.

Figure 4:
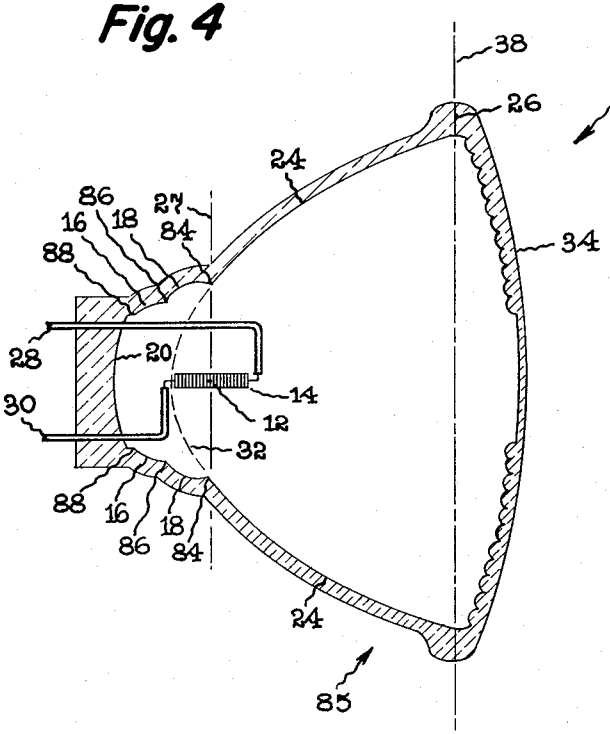
FIG. 4 is a cross section view of a lamp according to an alternate embodiment of the present invention.

A further embodiment of the present invention is shown in FIG. 4 which is similar to previously described FIG. 2 and where applicable shows the same reference numbers for the same elements. FIG. 4 is different than FIG. 2 in that it has transitional sections 84, 86 and 88 in lieu of transitional sections 21, 17, and 19, respectively. Transitional sections 84, 86 and 88 each having a predetermined radius such as the previously described radius of 21, 17, 19, respectively, define a sharp circumferential line of demarcations between the sections in which they are joined. The transitional section 84 joins the main parabolic section 24 with the first intermediate parabolic section 18. Transitional section 86 joins the first intermediate parabolic section 18 with the second intermediate parabolic section 16. Transitional section 88 joins the second intermediate section 16 with the rear parabolic section 20. The transitional sections 84, 86 and 88 may be those described in the previously mentioned U.S. patent application having Ser. No. 517,193 to which reference may be made for further details of transitional sections 84, 86 and 88.

Figure 5:
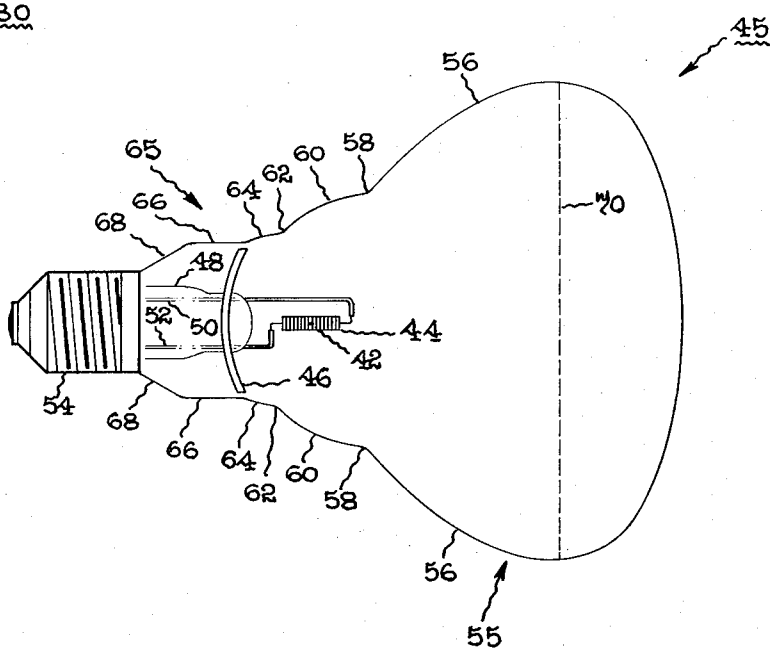
FIG. 5 shows a lamp according to a further embodiment of the present invention.

A further embodiment of the present invention is shown in FIG. 5 for a reflector (R) lamp 45. The reflector lamp 45 of FIG. 5 comprises a concave reflector having a first parabolic section 56, a second parabolic section 60, and a third parabolic section 64. At least the first and second parabolic sections 56 and 60 have an internal reflective surface and have a common focal point 42 which corresponds to the focal point of (R) lamp 45. The reflector lamp 45 has a light source 44 similar to that previously described light source 14 of FIG. 2, whose geometric center is located approximately at the common focal point 42 of the lamp 45.

The lamp 45 further comprises a heat shield 46 which may have a parabolic shape and a reflective surface located below the light source 14 so as to reflect light rays emitted by the light source 14 in a frontward manner. The parabolic heat shield 46 is formed of a material such as aluminum or steel for which the necessary heat shield may be of a material having a coating such as silver or other reflective substance.

The main parabolic section 56 is joined to the intermediate parabolic section by a transitional section 58 having a predetermined radius similar to transitional section 21. The second parabolic section 60 is joined to the third parabolic section 64 and by a transitional section 62 having a predetermined radius similar to transitional section 17. The third parabolic section 64 is formed into a nose portion 65 comprised of a substantially straight cylindrical section 66 and a convergent section 68. The section 68 is joined to an electrically conductive base 54.

The R lamp 45 of FIG. 5 having parabolic sections 56, 60 and 64 advantageously directs the light into a useful beam pattern in a manner similar to that described for lamps 10 and 80 of FIGS. 1, 2, 3 and 4. Similarly, the general teachings for the PARR lamps 10 and 80 may be applied to adapt lamps 10 and 80 into the R family of lamps such as described for lamp 45 of FIG. 5.

It will now be appreciated that the practice of the present invention provides improved PAR and R lamps having multiple parabolic sections and selected characteristics which more advantageously direct the light emitted by the light source into a desired beam pattern and reduce the undesirable amount of the internal absorption of the internal components of lamps 45, 80 and 10.

Although all three lamps 10, 45, and 80 of the present invention each having various embodiments have been described as having three parabolic sections 16, 18 and 20 such as for lamp 10, it should be recognized that the practice of this invention contemplates that only a multiple, such as two, for example, 16 and 20 or 18 and 20, need be utilized to improve the useful light output of the reflector lamp 10, 45 and 80. Further, the practice of this invention contemplates the implementation of more than three parabolic sections, such as 16, 18 and 20, to improve the useful light output of the reflector lamps 10, 45 and 80. The teachings of the aiming and improved columnation of the light rays emitted by the light source so as to increase the lumens in the main beam pattern, as hereinabove described, need to be followed for this invention to perform its desired improvement to the light output of lamps 10, 45 and 80.

Having thus described the invention, it will be apparent to those skilled in the art that various modifications can be made within the spirit and scope of the present invention.

What we claim as new and desire to secure by Letters Patent of the United States is:

1. A reflector lamp comprising a concave reflector and a finite light source having its geometric center located approximately at the focal point of the concave reflector, said concave reflector comprising a primary parabolic reflective section and at least first and second additional parabolic sections, said first and second additional parabolic sections being reflective and having a substantially common focal point confocal with the focal point of said concave reflector, said first and second additional parabolic sections being so aligned relative to said finite light source as to be effective to reflect light rays impinging on the surfaces to thereof onto said primary parabolic reflective section and thereby directing said light rays in an improved columnated beam pattern.

2. A reflective lamp according to claim 1 further comprising a lens located at the entrance of said reflector.

3. A reflector lamp according to claim 2 wherein said lens is contoured.

4. A reflector lamp according to claim 1 wherein said parabolic sections are joined by transitional sections each having a predetermined radius.

5. A reflector lamp according to claim 4 wherein said transitional sections each define a sharp circumferential line of demarcation.

6. A reflector lamp according to claim 1 further comprising a parabolic heat shield member having a reflective surface located below said light source so as to reflect light rays emitted by said light source in a more frontward manner.

7. A reflector lamp according to claim 1 wherein:

said concave reflector comprises;

a primary reflective section having a parabolic shape and a predefined focal point;

a first intermediate reflective section having a parabolic shape substantially confocal with said primary surface and joined to said primary reflective surface by a transitional section having a predetermined radius in the range of about 3 to about 4 mm;

a second intermediate reflective section having a parabolic shape substantially confocal with said primary and said first intermediate reflective sections and joined to said first intermediate reflective section by a transitional radius in the range of about 1 to about 2 mm, and;

a rear reflective section having a parabolic shape substantially confocal with said primary, first intermediate and second intermediate refractive sections and joined to said second intermediate reflective section by a transitional section having a predetermined radius in the range of about 1 to about 2 mm, and further wherein:

said finite source comprising a halogen gas light source having a focal point axially aligned approximately centered relative to said focal point of said concave reflective surface.

8. A reflector lamp according to claim 1 wherein:

said concave reflector comprises;

a primary reflective section having a parabolic shape and a focal point;

a first intermediate reflective section having a parabolic shape substantially confocal with said primary reflective surface and joined to said primary reflective section by a transitional section having a predetermined radius in the range of about 3 to about 4 mm;

a second intermediate reflective section having a parabolic shape substantially confocal with said primary and said first reflective sections and joined to said first intermediate reflective section by a transitional section having a predetermined radius in the range of about 1 to about 2 mm, and;

a rear reflective section having a parabolic shape substantially confocal with said primary, first intermediate and second intermediate reflective sections and joined to said second primary reflective section by a transitional section having a predetermined radius in the range of about 1 to about 2 mm, and further wherein:

said finite light source comprising a halogen gas light source having a focal point horizontally aligned approximately centered relative to said focal point of said concave reflector.

9. A reflector lamp according to claim 7 wherein each of said transitional sections define a sharp circumferential line of demarcation.

10. A reflector lamp according to claim 8 wherein each of said transitional sections define a sharp circumferential line of demarcation.

11. A reflector lamp according to claim 8 further comprising facets occupying a major portion of said front reflector section.

12. A reflector lamp according to claim 10 further comprising facets occupying a major portion of said front reflective section.

13. A reflector lamp according to claim 6 wherein:

said concave reflector comprises;

a primary reflective section having a parabolic shape and a focal point;

a first intermediate reflective section having a parabolic shape substantially confocal with said primary reflective surface and joined to said primary reflective section by a transitional section having a predetermined radius in the range of about 3 to about 4 mm, and;

a second intermediate reflective section having a parabolic shape substantially confocal with said primary and said first intermediate reflective sections joined to said first intermediate reflective section by a transitional section having a predetermined radius in the range of about 1 to about 2 mm, and;

a nose section comprised of a substantially straight cylindrical section and a convergent section, and further wherein:

said finite light source comprises a halogen gas light source having a focal point axially aligned approximately centered relative to said focal point of said concave reflector.

14. A reflector lamp according to claim 6 wherein:

said concave reflector comprises;

a primary reflective section having a parabolic shape and a focal point;

a first intermediate reflective section having a parabolic shape substantially confocal with said primary surface and joined to said primary reflective section by a transitional section having a predetermined radius in the range of about 3 to about 4 mm;

a second intermediate reflective section having a parabolic shape substantially confocal with said primary, and said first intermediate reflective sections and joined to said first intermediate reflective section by a transitional section having a predetermined radius in the range of about 1 to about 2 mm, and;

a nose portion comprised of a substantially straight cylindrical section and a convergent section, and further wherein:

said light source comprising a halogen gas light source having a focal point axially aligned relative to said focal point of said concave reflector.

* * * * *